US010610039B2

(12) United States Patent
Hameed

(10) Patent No.: US 10,610,039 B2
(45) Date of Patent: Apr. 7, 2020

(54) HOLIDAY ORNAMENT ASSEMBLY

(71) Applicant: Seerwan Hameed, Lewisville, TX (US)

(72) Inventor: Seerwan Hameed, Lewisville, TX (US)

( * ) Notice: Subject to any disclaimer, the term of this patent is extended or adjusted under 35 U.S.C. 154(b) by 407 days.

(21) Appl. No.: 15/710,948

(22) Filed: Sep. 21, 2017

(65) Prior Publication Data

US 2019/0082874 A1 Mar. 21, 2019

(51) Int. Cl.
*A47G 33/08* (2006.01)
*G10K 1/064* (2006.01)

(52) U.S. Cl.
CPC ..... *A47G 33/0818* (2013.01); *A47G 33/0809* (2013.01); *G10K 1/064* (2013.01)

(58) Field of Classification Search
CPC ..... A47G 33/0809; A47G 33/0819
See application file for complete search history.

(56) References Cited

U.S. PATENT DOCUMENTS

D6,780 S 7/1873 Cone
406,294 A * 7/1889 McLaughlin ..... G10K 1/062 340/397.5
408,440 A 8/1889 Slater
1,927,901 A 9/1933 Plagens
2,470,047 A * 5/1949 Nicorvo ..... G10K 1/064 340/328
2,593,917 A 4/1952 Pettit
2,817,080 A * 12/1957 Balduman ..... G10K 1/063 340/395.1
2,923,931 A 2/1960 Wannemacher
3,941,082 A 3/1976 Malta
4,466,329 A 8/1984 Hayward
4,677,892 A * 7/1987 Kramer ..... G10K 1/062 116/155
6,871,613 B2 3/2005 Murray et al.

* cited by examiner

*Primary Examiner* — Mark Ruthkosky
*Assistant Examiner* — Julia L Rummel

(57) ABSTRACT

A holiday ornament assembly for hanging includes a bell body that has an upper wall and peripheral wall that is attached to and extends downwardly therefrom. The peripheral wall has a bottom edge creating an opening into the bell body. A pendulum is pivotally attached to the bell body. The pendulum has an upper end and a lower end. The upper end extends through an aperture in the upper wall. A bob is attached to the lower end and positioned within the bell body. A housing is comprised of a top wall and a perimeter wall that is attached to the top wall and extends downwardly therefrom and attached to the upper wall. A hook is attached to and extends outwardly from the top wall. A drive assembly is mounted in the housing and pivots the pendulum to strike the bell body emitting a ringing sound.

6 Claims, 5 Drawing Sheets

HOLIDAY ORNAMENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to holiday ornament devices and more particularly pertains to a new holiday ornament device for ringing and configured to be hung on a tree.

BRIEF SUMMARY OF THE INVENTION

An embodiment of the disclosure meets the needs presented above by generally comprising a bell body that has an upper wall and peripheral wall that is attached to and extends downwardly from the upper wall. The peripheral wall has a bottom edge that forms an opening into the bell body. A pendulum is pivotally attached to the bell body. The pendulum has an upper end and a lower end. The upper end extends through an aperture in the upper wall. The lower end is positioned within the bell body. A bob is attached to the lower end. A ringing sound is emitted when the bob strikes the bell body. A housing is comprised of a top wall and a perimeter wall that is attached to the top wall and extends downwardly therefrom. The housing is attached to the upper wall. A hook is attached to and extends outwardly from the top wall. A drive assembly is mounted in the housing. The drive assembly is configured to move the pendulum to strike the bell body.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
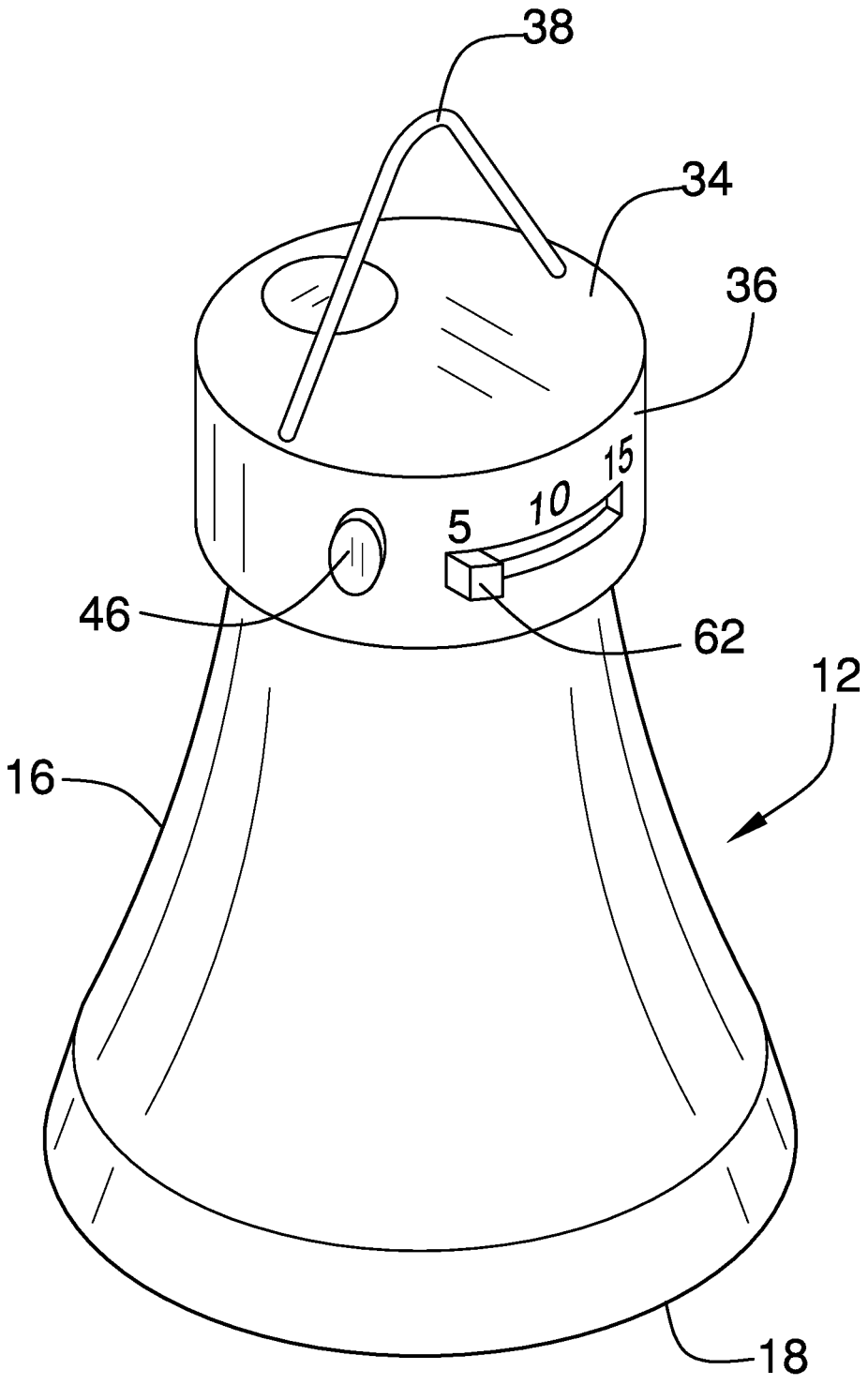
FIG. 1 is a front side view of a holiday ornament assembly according to an embodiment of the disclosure.
Figure 3:
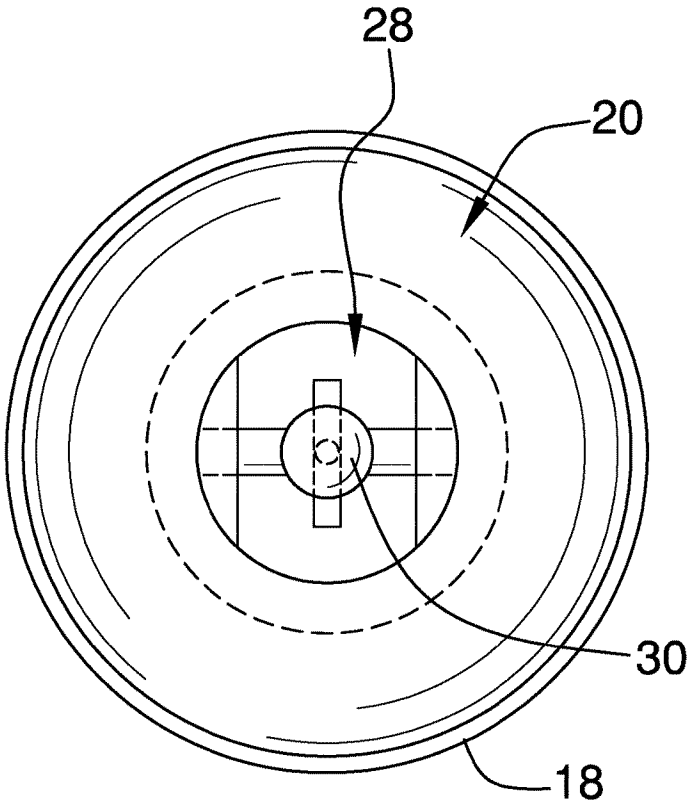
FIG. 3 is a bottom view of an embodiment of the disclosure.
Figure 2:
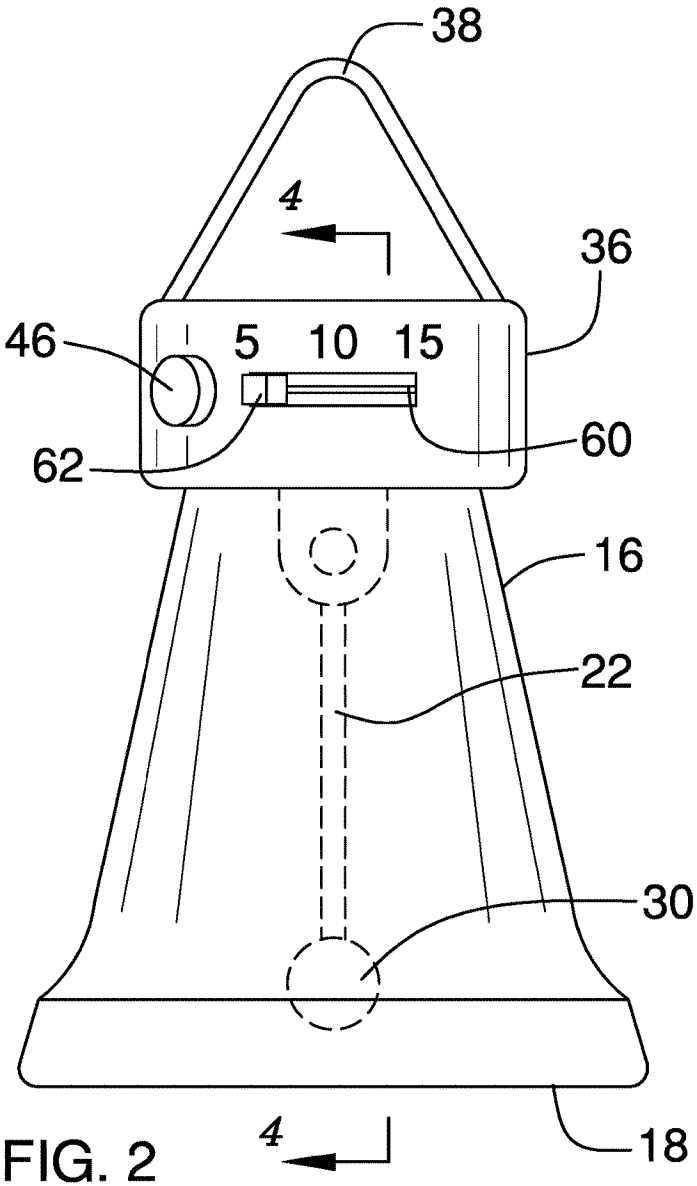
FIG. 2 is a front view of an embodiment of the disclosure.
Figure 4:
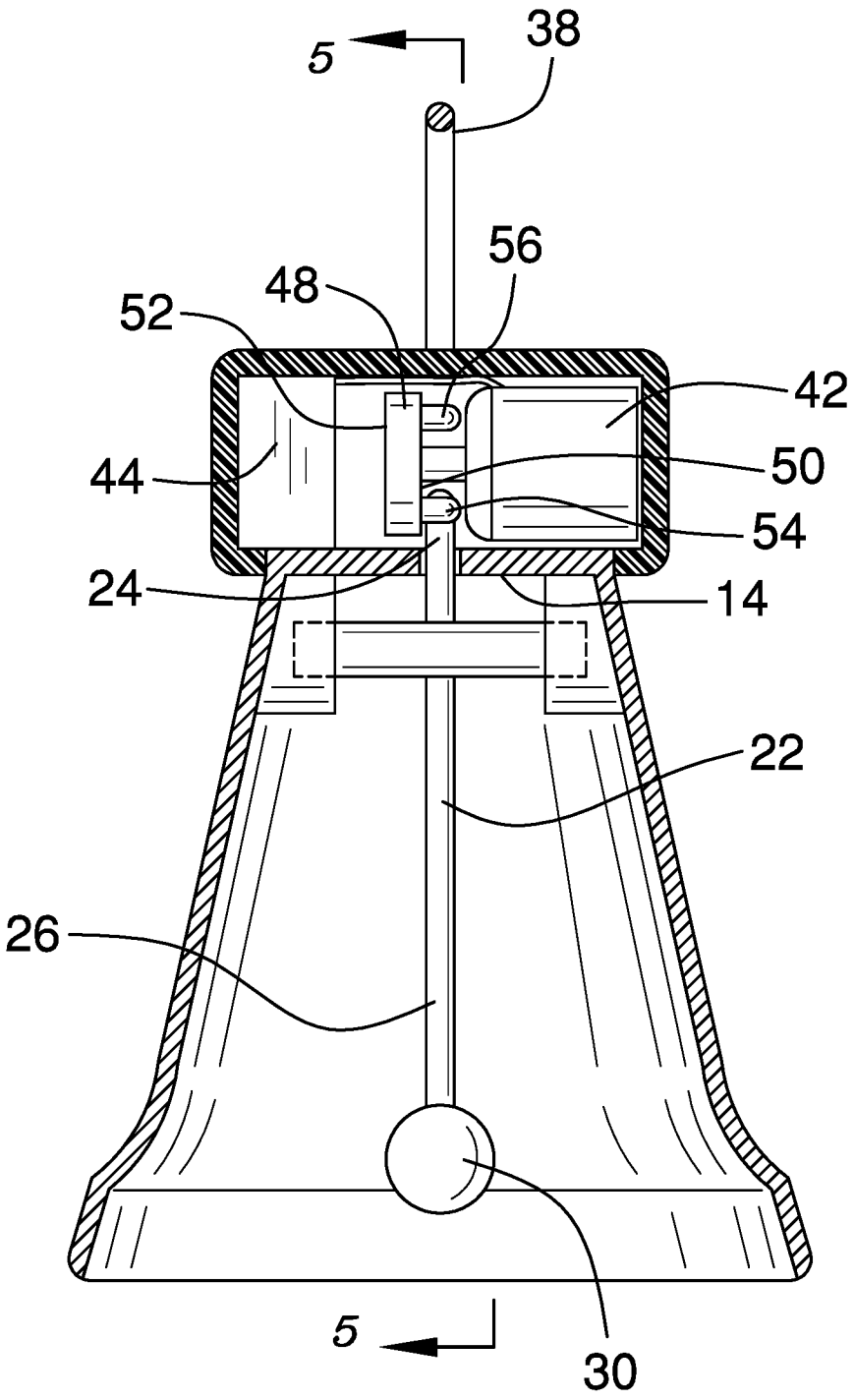
FIG. 4 is a cross-sectional view of an embodiment of the disclosure taken along line 5-5 of FIG. 6.
Figure 5:
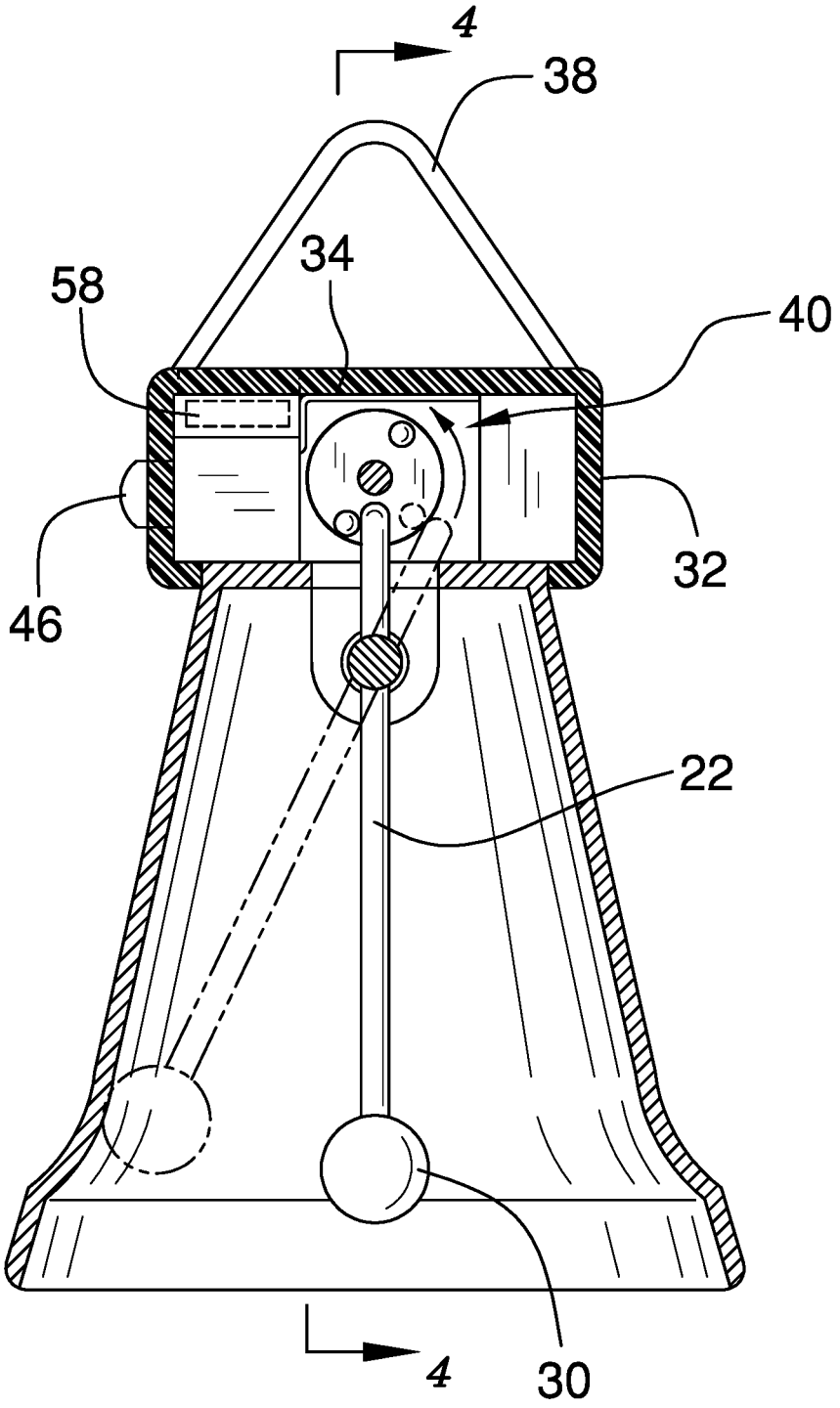
FIG. 5 is a cross-sectional view of an embodiment of the disclosure taken along the line 4-4 of FIG. 2.
Figure 6:
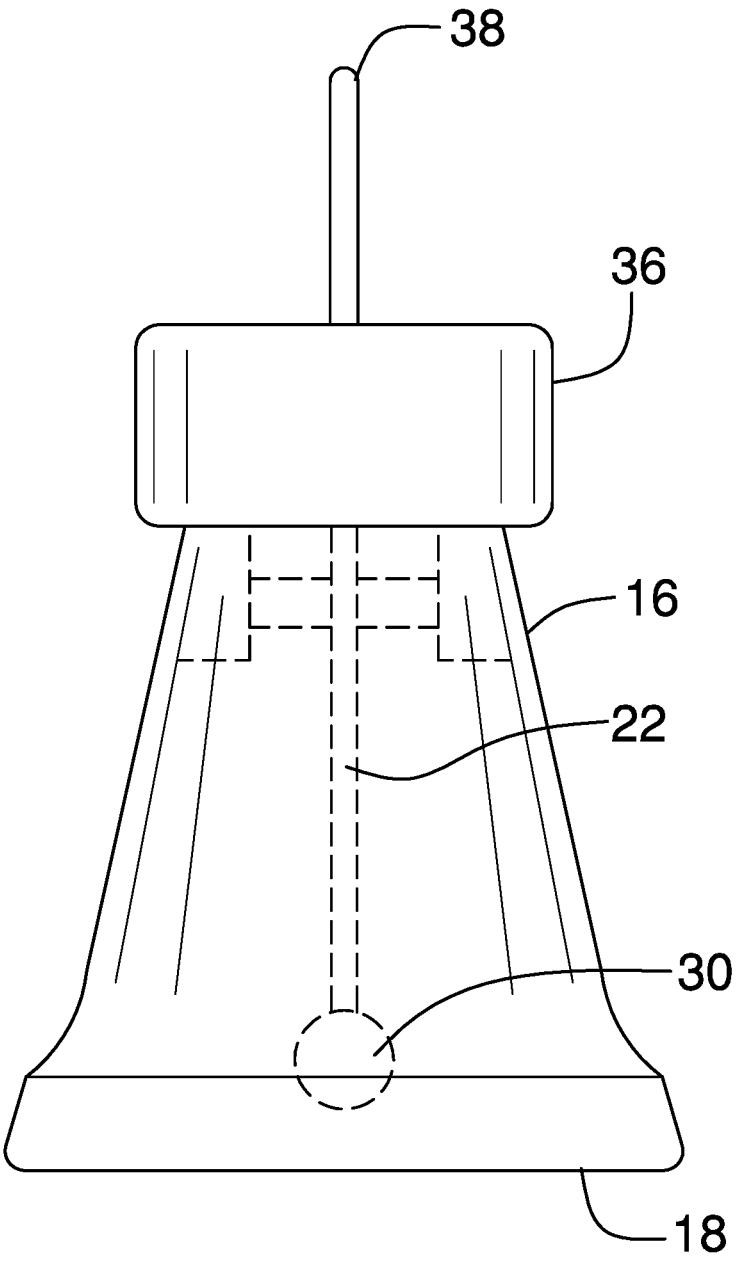
FIG. 6 is a side view of an embodiment of the disclosure.

With reference now to the drawings, and in particular to FIGS. 1 through 6 thereof, a new holiday ornament device embodying the principles and concepts of an embodiment of the disclosure and generally designated by the reference numeral 10 will be described.

As best illustrated in FIGS. 1 through 6, the holiday ornament assembly 10 generally comprises a bell body 12 that has an upper wall 14 and a peripheral wall 16 that is attached to and extends downwardly from the upper wall 14. The peripheral wall 16 has a bottom edge 18 forming an opening 20 into the inside of the bell body 12. The bell body 12 is comprised of a rigid material such as plastics, metals, glass, ceramics and the like. A pendulum 22 is pivotally attached to the bell body 12. The pendulum 22 has an upper end 24 and a lower end 26. The upper end 24 extends through an aperture 28 in the upper wall 24. The lower end 26 is positioned within the bell body 12. A bob 30 is attached to the lower end 26. The bob 30 may be comprised of a metal material, though other suitable materials including ceramics, glass, rigid plastics and the like may also be utilized. A ringing sound is emitted when the bob strikes the bell body.

A housing 32 is comprised of a top wall 34 and a perimeter wall 36 that is attached to the top wall 34 and extends downwardly therefrom. The housing 32 is attached to the upper wall 14. A hook 38 is attached to and extends outwardly from the top wall 34.

A drive assembly 40 is mounted in the housing 32. The drive assembly 40 is configured to move the pendulum 22 to strike the bell body 12. The drive assembly 40 includes a motor 42 and a battery 44 is electrically coupled to the motor 42. A power switch 46 is electrically coupled to the motor 42 to turn the drive assembly 40 on or off. A cam 48 that has a first side 50 and a second side 52 is rotatably coupled to the motor 42 such that the cam 48 rotates when the motor 42 is actuated to an on position. A first peg 54 and a second peg 56 are attached to the first side 50 of the cam 48. The first 54 and second pegs 56 are configured to engage with the upper end 24 such that when the first 54 and second pegs 56 engage the upper end 24 the bob 30 moves forward and strikes the bell body 12. A control circuit 58 is electrically coupled to the motor 42. A timer input 60 is electrically coupled to the control circuit 58. The timer input has a series of time limit inputs 62. The time limit inputs 62 each include a switch position and a timing program associated with each switch position. Each timing program includes a first period of time elapsed with the motor off and a second period of time elapsed with the motor on. The second period is at least 10.00 seconds and less than 25.00 seconds The series of timing programs may include a five minute program, a ten minute program and a fifteen minute program. The five minute program being initiated by putting the time limit input to the five minute input. The five minute program turns on the motor every 5.00 minutes for a period of at least 10.00 seconds and less than 25.00 seconds. A ten minute program may be initiated by putting the time limit input to the ten minute input. The ten minute program turns on the motor every 10.00 minutes for a period of at least 10.00 seconds and less than 25.00 seconds. The fifteen minute program being initiated by putting the time limit input to the fifteen minute program. The fifteen minute program turns on the motor every 15.00 minutes for a period of at least 10.00 seconds and less than 25.00 seconds. However, other timing programs may be used.

In use, the assembly 10 is used conventionally as a holiday ornament. The assembly 10 is hung by the hook 38 on a tree or on another surface the hook may be secured to. The power switch 46 is turned on and a time limit input 62 is selected. The control circuit 58 then runs the selected timing program turning on the motor 42 at the selected intervals. The motor 42 rotates the cam 48 wherein the first 54 and second pegs 56 engage the upper end. The upper end 24 moves the bob 30 into contact with the bell body 12 emitting a ringing sound.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A holiday ornament assembly configured for hanging on a tree, said assembly comprising:

a bell body having an upper wall and a peripheral wall being attached to and extending downwardly from said upper wall, said peripheral wall having a bottom edge forming an opening into said bell body;

a pendulum being pivotally attached to said bell body, said pendulum having an upper end and a lower end, said upper end extending through an aperture in said upper wall, said lower end being positioned within said bell body, a bob being attached to said lower end, a ringing sound being emitted when said bob strikes said bell body;

a housing comprising a top wall and a perimeter wall being attached to said top wall and extending downwardly therefrom, said housing being attached to said upper wall, a hook being attached to and extending outwardly from said top wall; and a drive assembly being mounted in said housing, said drive assembly being configured to move said pendulum to strike said bell body;

wherein said drive assembly includes:

a motor;

a battery being electrically coupled to said motor;

a power switch being electrically coupled to said motor to turn said drive assembly on or off;

a cam mechanically engaged with said pendulum; and a control circuit being electrically coupled to said motor; and wherein said cam has a first side and a second side, said cam being rotatably coupled to the motor such that said cam rotates when said motor is actuated to an on position, a first peg and a second peg being attached to said first side of said cam, said first and second peg being configured for engaging with said upper end such that when said first and second pegs engages said upper end said bob moves forward and strikes said bell body.

2. The holiday ornament assembly according to claim 1, wherein said bell body comprises a rigid material.

3. The holiday ornament assembly according to claim 1, wherein said bob is comprised of a metal material.

4. The holiday ornament assembly according to claim 1, wherein said drive assembly includes a control circuit being electrically coupled to said motor, a timer input being electrically coupled to said control circuit, said timer input having a series of time limit inputs, said time limit inputs each including a switch position and a timing program associated with each switch position, each timing program including a first period of time elapsed with said motor off and a second period of time elapsed with said motor on.

5. The holiday ornament assembly according to claim 4, wherein said second period is at least 10.00 seconds and less than 25.00 seconds.

6. A holiday ornament assembly configured for hanging on a tree, said assembly comprising:

a bell body having an upper wall and a peripheral wall being attached to and extending downwardly from said upper wall, said peripheral wall having a bottom edge forming an opening into said bell body, said bell body comprising a rigid material;

a pendulum being pivotally attached to said bell body, said pendulum having an upper end and a lower end, said upper end extending through an aperture in said upper wall, said lower end being positioned within said bell body, a bob being attached to said lower end, said bob being comprised of a metal material, a ringing sound being emitted when said bob strikes said bell body;

a housing comprising a top wall and a perimeter wall being attached to said top wall and extending downwardly therefrom, said housing being attached to said upper wall, a hook being attached to and extending outwardly from said top wall;

a drive assembly being mounted in said housing, said drive assembly being configured to move said pendulum to strike said bell body, said drive assembly including: a motor;

a battery being electrically coupled to said motor;

a power switch being electrically coupled to said motor to turn said drive assembly on or off;

a cam having a first side and a second side, said cam being rotatably coupled to the motor such that said cam rotates when said motor is actuated to an on position, a first peg and a second peg being attached to said first side of said cam, said first and second peg being configured for engaging with said upper end such that when said first and second pegs engages said upper end said bob moves forward and strikes said bell body; and a control circuit being electrically coupled to said motor, a timer input being electrically coupled to said control circuit, said timer input having a series of time limit inputs, said time limit inputs each including a switch position and a timing program associated with each switch position, each timing program including a first period of time elapsed with said motor off and a second period of time elapsed with said motor on, said second period being at least 10.00 seconds and less than 25.00 seconds.

* * * * *